US007574991B2

(12) United States Patent
Kumagai et al.

(10) Patent No.: US 7,574,991 B2
(45) Date of Patent: Aug. 18, 2009

(54) CAMSHAFT SUPPORT STRUCTURE FOR AN INTERNAL COMBUSTION ENGINE

(75) Inventors: Atsunori Kumagai, Sunto-gun (JP); Tetsushi Suzuki, Mishima (JP); Takanori Sasaki, Susono (JP); Shoichi Tateyama, Numazu (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 12/087,903

(22) PCT Filed: Jan. 18, 2007

(86) PCT No.: PCT/IB2007/000123

§ 371 (c)(1),
(2), (4) Date: Jul. 17, 2008

(87) PCT Pub. No.: WO2007/083222

PCT Pub. Date: Jul. 26, 2007

(65) Prior Publication Data

US 2009/0013958 A1 Jan. 15, 2009

(30) Foreign Application Priority Data

Jan. 19, 2006 (JP) ..... 2006-010947

(51) Int. Cl.
*F02B 77/00* (2006.01)
*F02F 7/00* (2006.01)

(52) U.S. Cl. ..... 123/195 C; 123/90.38; 123/195 H

(58) Field of Classification Search ..... 123/195 R, 123/195 H, 195 C, 90.38
See application file for complete search history.

(56) References Cited

U.S. PATENT DOCUMENTS

| | | | | |
|---|---|---|---|---|
| 4,823,747 | A | 4/1989 | Wagner et al. | |
| 5,150,675 | A * | 9/1992 | Murata | 123/195 H |
| 5,161,495 | A | 11/1992 | Saito | |
| 5,458,099 | A | 10/1995 | Koller et al. | |

FOREIGN PATENT DOCUMENTS

| | | |
|---|---|---|
| DE | 34 41 129 C1 | 7/1987 |
| DE | 36 41 129 C1 | 7/1987 |
| EP | 0 635 631 A1 | 1/1995 |
| GB | 1 201 558 | 8/1970 |
| JP | A 60-187706 | 9/1985 |

(Continued)

*Primary Examiner*—Noah Kamen
(74) *Attorney, Agent, or Firm*—Oliff & Berridge, PLC

(57) ABSTRACT

A lower cam carrier is disposed over a cylinder head and a head cover is disposed thereover. The lower cam carrier has, formed as one therewith, an outer frame superposed with the edge peripheral edge of the cylinder head, and a bridging part provided between opposing sides of the outer frame part. The bridging part has a lower bearing for supporting an intake camshaft and an exhaust camshaft. The head cover has, formed as one therewith, a flange part superposed with the outer frame part and a bearing part opposing the bridging part inside the flange part 22. The bearing part has an upper bearing that, together with the lower bearing, supports the intake camshaft and the exhaust camshaft.

10 Claims, 3 Drawing Sheets

FOREIGN PATENT DOCUMENTS

| | | |
|---|---|---|
| JP | A 60-195320 | 10/1985 |
| JP | A 63-176612 | 7/1988 |
| JP | A 1-138306 | 5/1989 |
| JP | A 02-248606 | 10/1990 |
| JP | U 02-147857 | 12/1990 |
| JP | U 03-97505 | 10/1991 |
| JP | A 05-280312 | 10/1993 |
| JP | U 06-22551 | 3/1994 |
| JP | A 06-288296 | 10/1994 |
| JP | U 06-83912 | 12/1994 |
| JP | A 07-166956 | 6/1995 |
| JP | A 08-246952 | 9/1996 |
| JP | A 11-247710 | 9/1999 |
| JP | A 2005-163703 | 6/2005 |
| JP | A 2006-504894 | 2/2006 |
| WO | WO 2004/040115 A1 | 5/2004 |

* cited by examiner

CAMSHAFT SUPPORT STRUCTURE FOR AN INTERNAL COMBUSTION ENGINE

BACKGROUND OF THE INVENTION

1. Field of the Invention

The present invention relates to a camshaft support structure for an internal combustion engine, and specifically to a camshaft support structure suitable for application to an internal combustion engine mounted in a vehicle.

2. Description of the Related Art

Japanese Patent Application Publication No. 7-166956(JP-A-7-166956) describes a head cover that is formed with an integral upper bearing for supporting a camshaft. A camshaft is used in an internal combustion engine to impart lift to an intake valve and an exhaust valve. When the camshaft lifts the intake valve or the exhaust valve, an associated repelling force impels the camshaft in the direction of the head cover. For this reason, the upper bearing supporting the camshaft on the head cover side is required to have a high degree of rigidity.

According to the described structure, because the upper bearing is provided integrally with the head cover, it exhibits a high rigidity. For this reason, it is possible to support the camshaft of the internal combustion engine with sufficient rigidity.

The head cover described above is tightened to the peripheral part of the cylinder head by bolts. The lower bearing that, together with the upper bearing, supports the camshaft is tightened to the head cover and to the cylinder head in a space formed between the head cover and the cylinder head. By adopting a structure such as this, the only location that needs to be sealed in the vicinity of the head cover is the boundary between the head cover and the cylinder head. In the disclosed structure, therefore, it is possible to reduce the risk of oil leakage while imparting high rigidity with respect to the structure supporting the camshaft.

However, because the head cover is only to tightened the cylinder head, the repelling force applied to the camshaft is transmitted only to the head cover and propagated only to the cylinder head. In other words, in the described structure, the repelling force applied to the camshaft is propagated in a concentrated manner in the vicinity of the edge at which the head cover and the cylinder head are tightened. For this reason, in the structure described in JP-A-7-166956, if it is not possible to achieve sufficient rigidity in the head cover, a condition can occur in which it is not possible to impart sufficient rigidity to the part supporting the camshaft.

SUMMARY OF THE INVENTION

The present invention provides a camshaft support structure for an internal combustion engine imparts high rigidity to the part that supports the camshaft, without relying on the rigidity of the head cover.

A first aspect of the present invention is a camshaft support structure for an internal combustion engine, having a cylinder head, a ladder frame type lower cam carrier having, formed as one, an outer frame superposed with a peripheral edge of the cylinder head, a bridging part bridging between opposite sides of the outer frame, and a lower bearing formed in the bridging part to support the camshaft, and a unitized upper cam carrier and head cover having, formed as one, a flange superposed with the outer frame, a bearing inside the flange disposed to oppose the bridging part, and an upper bearing formed on the bearing for supporting, together with the lower bearing, the camshaft.

According to the first aspect, the force applied to the camshaft is transmitted both to the unitized upper cam carrier and head cover and to the ladder frame type lower cam carrier. Thus, the unitized upper cam carrier and head cover and the ladder frame type lower cam carrier receive the force applied to the camshaft. By doing this, it is possible for the first aspect to achieve sufficient overall rigidity with respect to the camshaft supporting part, without relying on the rigidity of individual constituent elements.

A second aspect of the present invention is similar to the first aspect, except that the second aspect further has a peripheral tightening member tightening the peripheral edge of the cylinder head to the outer frame, and the outer frame to the flange, and a bearing tightening member between the outer frame and the lower bearing and between the flange and the upper bearing, which tightens the bridging part to the unitized upper cam carrier and head cover.

According to the second aspect, the unitized upper cam carrier and head cover and the ladder frame type lower cam carrier are tightened in the vicinity of the lower bearing and the upper bearing. By doing this, both elements are able to receive the force applied to the camshaft, making it possible in the second aspect to impart high rigidity to the camshaft supporting part.

A third aspect of the present invention is similar to the first or second aspects, except that in the third aspect the unitized upper cam carrier and head cover and the ladder frame type lower cam carrier are made of the same material, which is lighter than the material of the cylinder head.

According to the third aspect, the unitized upper cam carrier and head cover and ladder frame type lower cam carrier are made of a material that is lighter than the material of the cylinder head, and by achieving a high structural supporting rigidity, it is possible to achieve sufficient structural supporting rigidity, even when the elements are made from a light material. According to the third aspect, by making these elements from a light material, it is possible to lower the center of gravity in the internal combustion engine.

A fourth aspect of the present invention is similar to the first or second aspects, except that in the fourth aspect, the unitized upper cam carrier and head cover is made of a material that is lighter than the material of the ladder frame type lower cam carrier.

According to the fourth aspect, the unitized upper cam carrier and head cover is made of a material that is lighter than the material of the ladder frame type lower cam carrier, and by achieving a high structural supporting rigidity, it is possible to achieve sufficient structural supporting rigidity, even when these elements are made from a light material. Accordingly, by lightening the material of members positioned at the topmost part of the internal combustion engine, it is possible to lower the center of gravity in the internal combustion engine.

A fifth aspect of the present invention is similar to the third aspect, except that the cylinder head has an intake port opened on a side wall thereof, and wherein the boundary between the peripheral edge and the outer frame is formed in the immediate vicinity of the opening of the intake port.

In the fifth aspect, by adopting a constitution in which the boundary between the peripheral edge of the cylinder head and the outer frame of the ladder frame type lower cam carrier is formed in the immediate vicinity of the opening of the intake port, it is possible to minimize the height of the cylinder head, while forming the intake port inside the cylinder head. Specifically, according to the fifth aspect, by minimizing the height of the cylinder head, which is made of a heavy material, and maximizing the height of members made of a light material, it is possible to efficiently reduce the weight of the internal combustion engine.

A sixth aspect of the present invention is similar to the first through fifth aspects, except that the ladder frame type lower cam carrier is made of magnesium a magnesium alloy, or a compound resin material, and wherein a part of an intake air passage is formed inside the ladder frame type lower cam carrier.

According to the sixth aspect, it is possible to use a part of the ladder frame type lower cam carrier as a part of the intake air passage. Because the sixth aspect achieves a high structural support rigidity, it is possible to achieve sufficient support rigidity even if the ladder frame type lower cam carrier is made of magnesium, a magnesium alloy or a compound resin material. Additionally, because magnesium, a magnesium alloy and compound resin materials exhibit sound insulation and heat insulation properties superior to those of aluminum or cast iron, the sixth aspect has improved heat retention characteristics of intake air and reduced intake noise, while achieving sufficient support rigidity.

A seventh aspect of the present invention is similar to the first through sixth aspects, in which the ladder frame type lower cam carrier is made of magnesium, a magnesium alloy, or a compound resin material, and wherein a part of a fuel passage is formed inside the ladder frame type lower cam carrier.

According to the seventh aspect, it is possible to use a part of the ladder frame type lower cam carrier as a part of the fuel passage. By achieving a high structural supporting rigidity, the seventh aspect provides sufficient support rigidity, even if the ladder frame type lower cam carrier is made of magnesium, a magnesium alloy or a compound resin material. Additionally, because magnesium, a magnesium alloy and compound resin materials are superior to aluminum and cast iron in terms of sound insulation and heat insulation properties, it is possible to achieve a control of a decrease in fuel temperature and a reduction in noise that accompanies fuel supply while achieving sufficient support rigidity.

BRIEF DESCRIPTION OF THE DRAWINGS

The foregoing and further objects, features, and advantages of the invention will become apparent from the following description of preferred embodiments with reference to the accompanying drawings, wherein like numerals are used to represent like elements and wherein.

DETAILED DESCRIPTION OF THE PREFERRED EMBODIMENTS

Figure 1:
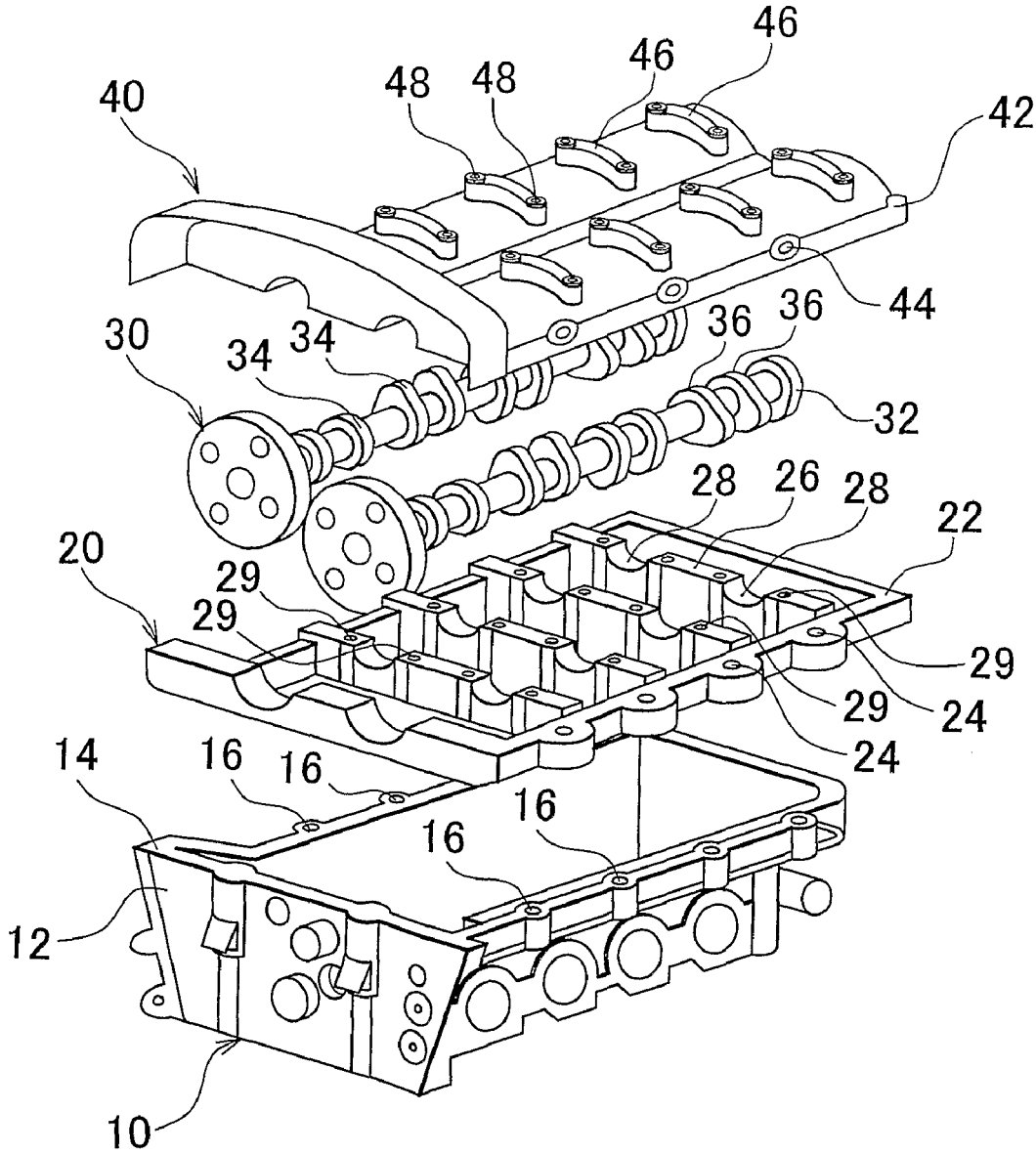
FIG. 1 is an exploded perspective view for describing a camshaft support structure according to a first embodiment of the present invention.

FIG. 1 will be used to describe a camshaft support structure according to the first embodiment of the present invention. More specifically, FIG. 1 is a perspective view showing in exploded form the constituent elements included in the structure of the embodiment. As shown in FIG. 1, the structure of the embodiment has a cylinder head 10 of an internal combustion engine.

The cylinder head 10 may be made of aluminum or cast iron. Various elements (not illustrated) necessary to configure four cylinders are formed within the cylinder head 10, which has a side wall 12 that surrounds these elements. The uppermost part of the side wall 12 is formed as an annular peripheral edge 14. A plurality of bolt-tightening holes 16 are provided farther to the outside of the peripheral edge 14 at a prescribed spacing between each bolt-tightening hole 16.

A ladder frame type lower cam carrier 20 (hereinafter simply "lower cam carrier 20") is assembled onto the top of the cylinder head 10. The lower cam carrier 20 has an outer frame 22 that is superposed with the peripheral edge 14 of the cylinder head 10. Bolt-tightening through holes 24 are provided farther to the outside of the outer frame 22, and are disposed to be superposed over the bolt-tightening holes 16 of the cylinder head 10.

Four bridging parts 26 are provided to the inside of the outer frame 22 that bridge the opposing sides of the outer frame 22. The bridging parts 26 are each disposed at the boundary of the four cylinders. The bridging parts 26 each have two lower bearings 28 formed therein. The lower bearings 28 are formed as upwardly open semicircles, to be able to support the camshaft from beneath. Bolt-tightening holes 29 are provided opened in the bridging part 26 on both sides of each of the lower bearings 28.

The lower cam carrier 20 is configured so that the four bridging parts 26 are integrally formed with the outer frame 22. The lower cam carrier 20 may be made of magnesium. Although magnesium is less rigid than the aluminum or cast iron of which the cylinder head 10 is generally made, it is lighter than aluminum and cast iron, and has superior sound insulation and heat insulation characteristics. Lower bearings 28 are formed as convex semicircles in each bridge part 26.

If the lower cam carrier 20 is made of magnesium, therefore, a number of characteristics are exhibited in contrast to those of aluminum or cast iron. For example, it is difficult to achieve rigidity with the lower cam carrier 20 alone. Reducing the weight of the lower cam carrier 20 enables lightens, and lowers the center of gravity of, the internal combustion engine. The vibration attenuation characteristics, and suppression of vibration and effect of reducing radiated noise are improved. Additionally, heat conduction and heat radiation are suppressed, thereby improving the warm-up characteristics of the internal combustion engine.

An intake camshaft 30 and an exhaust camshaft 32 are assembled to the top of the lower cam carrier 20 so that they are held by the four lower bearings 28 aligned in the axial direction of the camshafts. In the embodiment, each of the cylinders has two intake valves and two exhaust valves (not illustrated). The intake camshaft 30 and the exhaust camshaft 32 each has two cams 34, 36 for each cylinder, disposed to oppose the intake valves and the exhaust valves, respectively.

An unitized upper cam carrier and head cover 40 (hereinafter simply "head cover 40") is further fixed to the top of the lower cam carrier 20. The head cover 40 has a flange 42 that is superposed with the outer frame 22 of the lower cam carrier 20, formed to cover the entire surface of the lower cam carrier 20 while supporting the intake camshaft 30 and the exhaust camshaft 32.

The flange 42 has a plurality of bolt-tightening through holes 44 disposed that are superposed over the bolt-tightening through holes 24 of the lower cam carrier 20. The head cover 40 and the lower cam carrier 20 are fixed to the cylinder head 10 by passing bolts (not illustrated) through these bolt-tightening through holes 24, 44 and tightening them into the bolt-tightening holes 16.

The head cover 40 has a plurality of bearings 46. Each bearing 46 is provided opposite a corresponding lower bearing 28, and the head cover 40 has upper bearings (not illustrated) that form pairs with the lower bearings 28 in its inside. The upper bearings, together with the lower bearings 28, support the intake camshaft 30 or the exhaust camshaft 32. The upper bearings are formed, similar to the lower bearings 28, as convex semicircles.

Each of the individual bearings 46 have two bolt-tightening through holes 48 that are superposed over corresponding bolt-tightening holes 29 of the lower cam carrier 20. The head cover 40 and the lower cam carrier 20 are also fixed by tightening bolts (not illustrated) in the immediate vicinity of the upper and lower bearings at the positions of these bolt-tightening holes 29 and bolt-tightening through holes 48.

Figure 2:
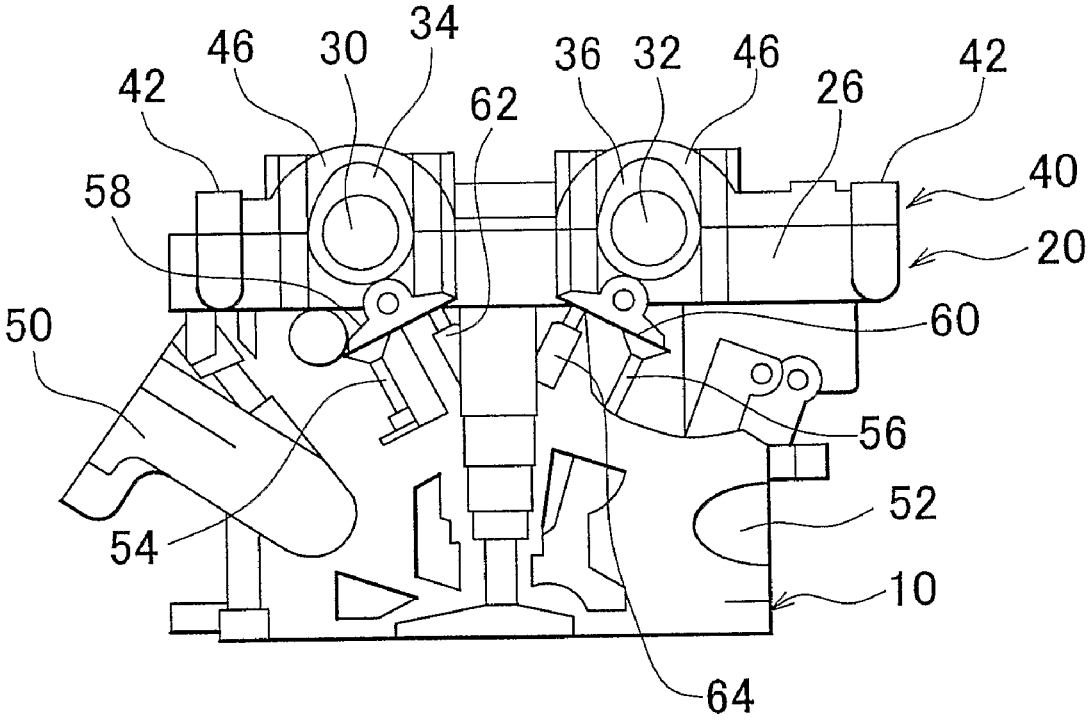
FIG. 2 is a cross-sectional view of the camshaft support structure according to the first embodiment, obtained on a plane cutting through one cylinder.

FIG. 2 is a cross-sectional view showing the camshaft support structure of the embodiment, obtained on a plane cutting through the center of one cylinder. As shown in FIG. 2, inside the head cover 40, the bearings 46 on the intake side and the exhaust side are integrally formed with the left and right sides of the flange 42. The parts extending between the left and right of the flange part 42 (including the bearing parts 46) are themselves opposite and connected to the bridging parts 26 of the lower cam carrier 20.

The head cover 40, in the same manner as the lower cam carrier 20, may also be made of magnesium. For this reason, the head cover 40, similar to the lower cam carrier 20, exhibits the following characteristics. It is difficult to achieve rigidity with the head cover 40 alone. Reducing the weight of the head cover 40 lightens and lowers the center of gravity of the internal combustion engine. The vibration attenuation characteristics, and suppression of vibration and effect of reducing radiated noise are improved. Additionally, heat conduction and heat radiation are suppressed, thereby improving the warm-up characteristics of the internal combustion engine.

As shown in FIG. 2, in addition to the cylinder head 10 being provided with intake ports 50 and exhaust ports 52 for each cylinder, these are combined with intake valves 54 and exhaust valves 56 that open and close the respective ports. One end of the intake valves 54 and the exhaust valves 56 make contact with one ends of the rocker arms 58, 60. The rocker arms 58, 60 are supported at the other ends thereof by lash adjusters 62, 64.

More specifically, the rocker arm 58 is supported from beneath by the lash adjuster 62 and the intake valve 54, and the rocker arm 58 is also supported from above by the intake side cam 34. The lash adjuster 62 supports the rocker arm 58 without changing its position. In contrast, the intake valve 54 is impelled in the closing direction by a valve spring (not illustrated). For this reason, when the nose of the cam 34 presses against the rocker arm 58, the rocker arm 58 rocks about the contact point with the lash adjuster 62 as a pivot point, thereby causing the intake valve 54 to lift in the opening direction. When this occurs, a repelling force of the valve spring is applied to the intake camshaft 30. That is, each time the nose of the cam 34 presses against the rocker arm 58 a repelling force is applied to the intake camshaft 30 in the upward direction in the drawing.

As a result, a large upwardly directed repelling force acts on the intake camshaft 30, synchronized to the timing of the opening of the intake valve 54 for each cylinder, and at a position corresponding to each cylinder. For the same reason, a large upwardly directed repelling force acts on the exhaust camshaft 32, synchronized to the timing of the opening of the exhaust valve 56 for each cylinder, and at a position corresponding to each cylinder. For this reason, the support structure for the intake camshaft 30 and the exhaust camshaft 32 must sufficiently be rigid to withstand such repelling forces.

In the embodiment, the bearing 46 having upper bearings is integrally with the head cover 40. By adopting this structure, it is possible to increase the rigidity of the bearings 46 by the rigidity of the head cover 40 itself, and possible to increase the rigidity of the upper bearings in comparison to the case where separate upper bearings are provided.

According to the embodiment, the bridging parts 26 having the lower bearings 28 are integrally formed with the outer frame 22. By adopting this structure, it is possible to support the individual bridging parts 26 by the outer frame 22, and possible to increase the rigidity of the lower bearings 28 in comparison to the case where separate lower bearings are provided.

As described above, in the structure of the embodiment the upper bearings and lower bearings 28 each have high rigidity independently. In addition, in the structure of the embodiment, as will be described below, by combining the head cover 40 and the lower cam carrier 20, it is possible to impart a very high degree of rigidity to the support structure for the intake camshaft 30 and the exhaust camshaft 32.

That is, according to the embodiment, the parts that form pairs of upper and lower bearings, at all locations, are linked to the cylinder head 10 via a dual structure in which the head cover 40 and the bridging parts 26 are superposed. That is, the head cover 40 contacts the bridging parts 26 in the vicinity of the parts at which pairs of upper and lower bearings are formed, including the flange 42 or the outer frame 22 at the right and left. The members of this dual structure, because of the linking of the bearings by the bolts, give the appearance of function as a single strong structural member.

According to this structure, the force received by the intake camshaft 30 or the exhaust camshaft 32, regardless of the location on the internal combustion engine, is transmitted to the cylinder head 10 via the dual structure member that is formed by the head cover 40 and the bridging parts 26. Thus, according to the support structure of the embodiment, the rigidity that contributes to support of the camshafts is largely determined by the rigidity of the above-noted dual structure member.

Compared with the rigidity of a single head cover 40 or of a single bridging part 26, the dual structure member formed by the superposition of these elements is extremely high. For this reason, the support structure of the embodiment has highly suitable characteristics for achieving camshaft support rigidity, in concert with the high rigidity exhibited individually by the upper-bearings and the lower bearings 28.

In the embodiment, as described above, the head cover 40 and the lower cam carrier 20 are made of magnesium, which is less rigid than aluminum or cast iron. However, the structure of the embodiment, as described above, makes it easy to achieve camshaft support rigidity. For this reason, this structure can achieve sufficient rigidity to support the camshaft, even if the head cover 40 and the lower cam carrier 20 are formed from magnesium.

As described above, in the structure of the embodiment the upper bearings and the lower bearings 28 each alone have high rigidity. According to this structure, it is possible to achieve an overall high camshaft support rigidity. For this reason, the embodiment can achieve the following effects.

The first effect is that, according to the structure of the embodiment, it is possible to easily machine the lower bearings and upper bearings 28 with high precision. Stated differently, in the structure of the embodiment because the upper bearings and the lower bearings 28 each alone have high rigidity, it is possible to machine these bearings with good accuracy in a short period of time. These characteristics make the structure of the embodiment suitable for reducing the cost of an internal combustion engine.

The second effect is that, according to the structure of the embodiment, because not only do the upper bearings and the lower bearings 28 exhibit high individual rigidity, but also it is possible to achieve a high overall camshaft support rigidity, it is possible to enhance the sealing performance at various sealed locations in the internal combustion engine. These characteristics make the structure of the embodiment suitable for reducing the risk of oil leakage in an internal combustion engine.

The third effect is that, because the upper bearings and the lower bearings 28 each have high rigidity alone and it is possible to achieve a high overall camshaft support rigidity, it is possible to reduce noise and vibration of the internal combustion engine during operation. This characteristics makes the structure of the embodiment suitable for improving the quietness of the internal combustion engine.

The fourth effect is that, according to the structure of the embodiment, it is possible suppress the deformation of the cam journal bearings to a sufficiently low level. As a result, it is possible to significantly reduce the rotational resistance of the intake camshaft 30 and the exhaust camshaft 32. Thus, the structure of the embodiment enables a reduction in fuel consumption and increase in the output power of the internal combustion engine.

The fifth effect is that, according to the structure of the embodiment, it is possible to stabilize the behavior of the intake valves 54 and the exhaust valves 56 and increase the maximum rpm of the internal combustion engine. For this reason, the structure of the embodiment enables output power of the internal combustion engine to be increased.

As shown in FIG. 2, the boundary between the cylinder head 10 and the lower cam carrier 20 in the structure of the embodiment is established immediately above the intake port 50. By adopting this constitution, it is possible to minimize the height of the cylinder head 10 while forming the intake port 50 within the cylinder head 10. Stated differently, according to this constitution, it is possible to maximize the dimensions of the lower cam carrier 20 and the head cover 40 within the dimensions given by the internal combustion engine.

The lower cam carrier 20 and the head cover 40 are made of magnesium. In contrast, the cylinder head 10 may be made of aluminum or cast iron, which is heavier than magnesium. For this reason, by maximizing the dimensions of the lower cam carrier 20 and the head cover 40 and minimizing the height of the cylinder head 10, it is possible to maximize the reduction in weight of the internal combustion engine and lower the center of gravity.

As described above, in the structure of the embodiment the lower cam carrier 20 and the head cover 40 are given the maximum allowable dimensions (thicknesses). The greater the thicknesses of the outer frame 22 of the lower cam carrier 20 and the flange 42 of the head cover 40, the greater their rigidity. According to this design concept, therefore, it is possible to achieve the maximum rigidity in the outer frame 22 and the flange 42 within the given degree of freedom.

The achievement of high rigidity in the outer frame 22 and the flange 42 not only achieves a high rigidity in the camshaft support structure, but also greatly reduces the risk of oil leakage. That is, when using the support structure of the embodiment, a location should be sealed occurs between the cylinder head 10 and the lower cam carrier 20 and between the lower cam carrier 20 and the head cover 40.

The head cover 40 and the lower cam carrier 20 are fixed by tightening bolts to the peripheral edge 14 of the cylinder head 10. Oil leaks generally tend to occur in a region between tightening bolts, and the less rigid the members to be sealed are, the easier it is for oil leakage to occur.

In the constitution of the embodiment, the members that require sealing are the peripheral edge 14 of the cylinder head 10, the outer frame 22 of the lower cam carrier 20, and the flange 42 of the head cover 40. The peripheral edge 14, because it is made of highly rigid aluminum, is sufficiently rigid. The outer frame 22 and the flange 42, although they are made of magnesium, because made sufficiently thick and also because they essentially function as a single strong structure (because they are tightened in the vicinity of the bearings), both are sufficiently rigid.

For this reason, according to the support structure of the embodiment, it is possible to sufficiently solve the problem of the risk of oil leakage in an internal combustion engine, regardless of there being two locations that require sealing, and regardless of the lower cam carrier 20 and the head cover 40 being made of magnesium.

As described above, magnesium is superior to aluminum and cast iron in terms of attenuation of vibration. For this reason, if the lower cam carrier 20 and the head cover 40 are made of magnesium, the sound insulation and suppression of vibration are improved in the internal combustion engine. In addition, as described above, maximum dimensions are given to the lower cam carrier 20 and the head cover 40. By doing so, it is possible to enjoy the maximum benefit of the effect sound insulation and vibration suppression offered by the use of magnesium.

Whereas in the first embodiment the lower cam carrier 20 and the head cover 40 are both tightened to the cylinder head 10 using tightening bolts, the present embodiment is not restricted in that constitution. That is, the lower cam carrier 20 may be first tightened to the cylinder head 10 and then the head cover 40 may be tightened to the lower cam carrier 20, or the head cover 40 may be tightened to both the lower cam carrier 20 and the cylinder head 10. Alternatively, the lower cam carrier 20 may be first tightened to the head cover 40 and both of these elements may then be tightened to the cylinder head 10.

Although in the first embodiment the lower cam carrier 20 and the head cover 40 are both made of magnesium, the present embodiment is not restricted in that manner. That is, the lower cam carrier 20 and the head cover 40 may be made of a magnesium alloy or of a compound resin material that has superior vibration attenuation characteristics and that is lighter than aluminum and cast iron. If this constitution is adopted, it is substantially possible to achieve the same effect as the first embodiment.

Additionally, one of the lower cam carrier 20 and the head cover 40 may be made of aluminum or cast iron and the other only may be made of magnesium, a magnesium alloy, or a compound resin material. If this constitution is adopted, it is possible to achieve a weight reduction effect in at least one of the lower cam carrier 20 and the head cover 40 while achieving sufficient support rigidity. In particular, if the head cover 40 is made of magnesium, a magnesium alloy, or a compound resin material, it is possible to efficiently achieve a lowering of the center of gravity of the internal combustion engine as well.

In addition, the lower cam carrier 20 and the head cover 40 may be made of aluminum or cast iron. Because the support structure of the embodiment has characteristics that are suitable for the achievement of high rigidity, if these elements are made of aluminum or cast iron, it is possible to achieve the desired rigidity while making the thickness at various locations thin. For this reason, according to the support structure of the embodiment, it is possible to contribute to the weight reduction of the internal combustion engine, even if the lower cam carrier 20 or the head cover 40 is made of aluminum or cast iron.

Also, in the support structure of the above-described embodiment, a fuel pump that uses the rotation of the intake camshaft 30 or the exhaust camshaft 32 as drive power may be added above the intake camshaft 30 or the exhaust camshaft 32. If this type of fuel pump is added, a large downwardly directed repelling force is applied to the camshaft that drives the pump, this being a large repelling force that the lower bearing is to receive. The support structure of the embodiment, for the same reason of exhibiting a high rigidity with respect to a force to be received by the upper bearings, has a high rigidity with respect to a force to be received by the lower bearings as well. For this reason, according to the support structure of the embodiment it is possible to support the intake camshaft 30 and the exhaust camshaft 32 with sufficient precision, even if a fuel pump such as noted above is added.

In the first embodiment described above, the tightening bolt that is passed through the bolt-tightening through holes 44, 24 and tightened into the tightening hole 16 is an example of the "peripheral tightening member" of the second aspect of the present invention, and the tightening bolt that is passed through the bolt-tightening through hole 48 and tightened into the bolt-tightening hole 29 is an example of the "bearing tightening member" of the second aspect of the present invention.

Figure 3:
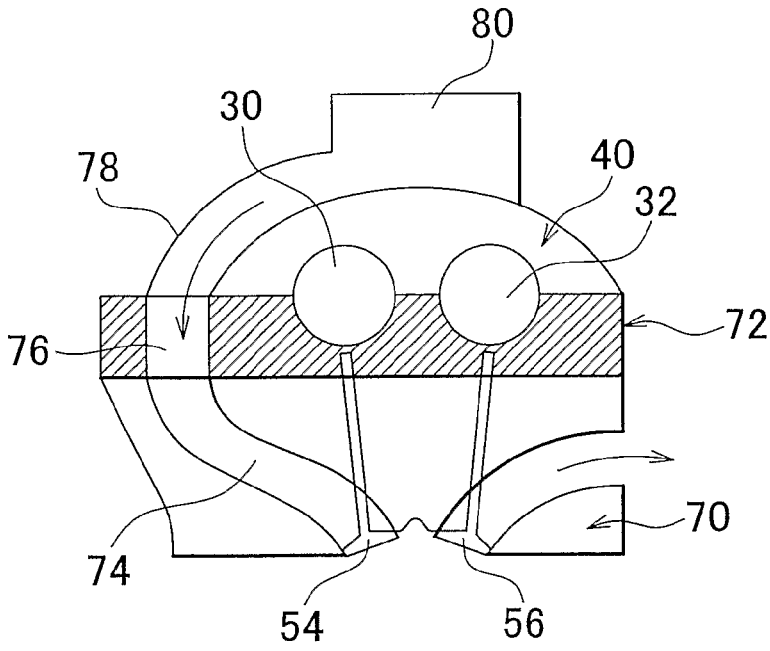
FIG. 3 is a drawing for describing a camshaft support structure according to a second embodiment of the present invention.

FIG. 3 is presented for describing the constitution of the second embodiment of the present invention. More precisely, FIG. 3 is a conceptual drawing with details omitted for describing the features of the support structure of the embodiment. For example, the head cover 40 shown in FIG. 3 is the same as the head cover 40 shown in FIG. 1 or FIG. 2. In the following, elements in FIG. 3 that are the same as in FIG. 1 or FIG. 2, similar to the head cover 40, are assigned the same reference numerals and are not described or described in brief.

The support structure of the embodiment has a cylinder head 70 and a lower cam carrier 72. The cylinder head 70, in the same manner as the cylinder head 10 of the first embodiment, is made of aluminum or cast iron. In contrast, the lower cam carrier 72, similar to the first embodiment, is made of magnesium.

An intake port 74 is formed in cylinder head 70 so that it opens toward the bottom of the lower cam carrier 72. The lower cam carrier 72 is provided with a port linking passage 76 that communicates with the intake port 74. The lower cam carrier 72, with the exception of having the port linking passage 76, is substantially the same as the lower cam carrier 20 in the first embodiment.

In the camshaft support structure of the embodiment, an intake pipe 78 connected to the port linking passage 76 is provided on the head cover 40 formed along the outer portion of the head cover 40, in addition to the provision of a surge tank 80 communicating with the intake pipe 78.

According to the foregoing constitution, it is possible to house the internal combustion engine, the intake pipe 78, and the surge tank 80 in a small space, thereby promoting a space savings in the engine compartment. By adopting such as constitution, it is possible to have the port linking passage 76 formed in the lower cam carrier 72 function as a part of the intake port.

Because, the lower cam carrier 72 is made of magnesium, it exhibits superior sound insulation and heat insulation. For this reason, if the port linking passage 76 that serves as a part of the intake port is provided inside the lower cam carrier 72, it is possible to achieve good intake air temperature maintenance and an improvement in cold starting performance. This constitution additionally improves the sound insulation properties of the intake and improves the quietness of the internal combustion engine.

Although the second embodiment as described above has a lower cam carrier 72 made of magnesium, the present embodiment is not restricted in this manner. Specifically, the lower cam carrier 72 may be alternatively be made of a magnesium alloy or a compound resin material, which has superior sound insulation and heat insulation properties.

Figure 4:
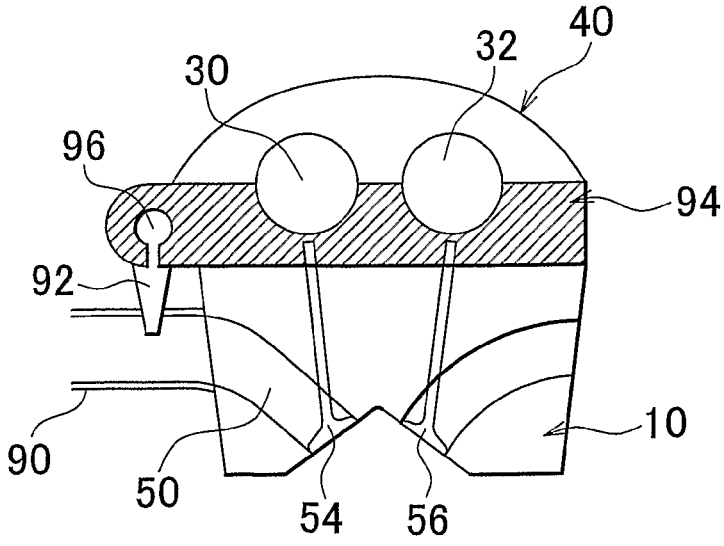
FIG. 4 is a drawing for describing a camshaft support structure according to a third embodiment of the present invention.

FIG. 4 is presented for describing the constitution of the third embodiment of the present invention. More precisely, FIG. 4 is a conceptual drawing with details omitted for describing the features of the support structure of the embodiment. For example, the head cover 40 shown in FIG. 4 is the same as the head cover 40 shown in FIG. 1 or FIG. 2. In the following, elements in FIG. 4 that are the same as in FIG. 1 or FIG. 2, similar to the head cover 40, are assigned the same reference numerals and are not described or described in brief.

The support structure of the embodiment has a cylinder head 10. The cylinder head 10 is linked to an intake pipe 90 to communicate with the intake port 50. A fuel injection valve 92 that injects fuel into the intake port 50, is assembled to the intake pipe 90.

A lower cam carrier 94 is disposed between the cylinder head 10 and the head cover 40. A fuel passage 96 is provided in the lower cam carrier 94. The fuel passage 96 extends in the serial line direction of the plurality of cylinders of the internal combustion engine, and communicates with all of the fuel injection valves 92 of each cylinder. Therefore, all the fuel injection valves 92 of the internal combustion engine can receive the fuel supplied from the fuel passage 96.

In the conventional configuration of an internal combustion engine, the fuel passage that communicates with the fuel injection valves is provided separately from the internal combustion engine itself. Compared to a conventional configuration, according to the constitution of the embodiment, because the fuel passage 96 is not provided as a separate member, it is possible to reduce the number of components. This constitution additionally enables the promotion of a saving of space in the engine compartment.

A fuel passage such as noted above in an internal combustion engine is usually made of aluminum or cast iron. When using such a fuel passage, the fuel flowing through the passage is inevitably heated by heat radiated from the internal combustion engine. In contrast, in the support structure of the embodiment, because the fuel passage 96 is formed within the magnesium, it is possible to limit the conduction of heat to the fuel to the minimum. For this reason, the structure of the embodiment enables the suppression of overheating of the fuel.

Although the above-described third embodiment has a lower cam carrier 94 made of magnesium, the present embodiment is not restricted in this manner. Specifically, the lower cam carrier 94 may be made of a magnesium alloy or a compound resin material having superior sound insulation and heat insulation properties.

While the invention has been shown and described with respect to the preferred embodiments, it will be understood by those skilled in the art that various changes and modifications may be made without departing from the scope of the invention as defined in the following claims.

The invention claimed is:

1. A camshaft support structure for an internal combustion comprising:

a cylinder head;

a camshaft;

a ladder frame lower cam carrier, in which a bridging part is integrally formed with an outer frame, that is superposed over a peripheral edge of the cylinder head, wherein the bridging part bridges the opposite sides of the outer frame, and a lower bearing that supports the camshaft is formed in the bridging part; and a unitized upper cam carrier and head cover, in which a bearing is integrally formed with a flange, that is superposed over the outer frame, wherein the bearing is provided on the inside of the flange and is disposed opposite a corresponding the bridging part, and an upper bearing that is formed on the bearing and that, together with the lower bearing, supports the camshaft.

2. The camshaft support structure for an internal combustion engine according to claim 1, further comprising:

a peripheral tightening member that tightens the peripheral edge of the cylinder head to the outer frame, and the outer frame to the flange; and a bearing tightening member, between the outer frame and the lower bearing and between the flange and the upper bearing, that tightens the bridging part to the unitized upper cam carrier and head cover.

3. The camshaft support structure for an internal combustion engine according to claim 1, wherein the unitized upper cam carrier and head cover and the ladder frame type lower cam carrier are made of the same material, which is lighter than the material of the cylinder head.

4. The camshaft support structure for an internal combustion engine according to claim 3, wherein the cylinder head has an intake port formed on a side wall thereof, and wherein a boundary between the peripheral edge and the outer frame is formed in the immediate vicinity of an opening of the intake port.

5. The camshaft support structure for an internal combustion engine according to claim 3, wherein the unitized upper cam carrier and head cover and the ladder frame type lower cam carrier are made of at least one of magnesium, a magnesium alloy, and compound resin material.

6. The camshaft support structure for an internal combustion engine according to 1, wherein the unitized upper cam carrier and head cover is made of a material lighter than the material of the ladder frame type lower cam carrier.

7. The camshaft support structure for an internal combustion engine according to claim 6, wherein the unitized upper cam carrier and head cover is made of at least one of magnesium, a magnesium alloy, and a compound resin material.

8. The camshaft support structure for an internal combustion engine according to 1, wherein the ladder frame type lower cam carrier is made of magnesium, a magnesium alloy, or a compound resin material, and wherein a part of an intake air passage is formed inside the ladder frame type lower cam carrier.

9. The camshaft support structure for an internal combustion engine according to claim 1, wherein the ladder frame type lower cam carrier is made of magnesium, a magnesium alloy, or a compound resin material, and wherein a part of a fuel passage is formed inside the ladder frame type lower cam carrier.

10. The camshaft support structure for an internal combustion engine according to claim 1, further comprising:

a fuel pump, disposed above the camshaft, that is driven by the rotation of the camshaft.

* * * * *